US010094152B2

(12) United States Patent
Akinbobola

(10) Patent No.: US 10,094,152 B2
(45) Date of Patent: Oct. 9, 2018

(54) DEHYDRATOR DOOR OPENING DEVICE

(71) Applicant: Victor Akinbobola, West Chester, OH (US)

(72) Inventor: Victor Akinbobola, West Chester, OH (US)

(73) Assignee: LEM PRODUCTS DISTRIBUTION LLC, West Chester, OH (US)

( * ) Notice: Subject to any disclaimer, the term of this patent is extended or adjusted under 35 U.S.C. 154(b) by 324 days.

(21) Appl. No.: 15/046,996

(22) Filed: Feb. 18, 2016

(65) Prior Publication Data

US 2017/0241174 A1 Aug. 24, 2017

(51) Int. Cl.

| | |
|---|---|
| ***E05F 1/00*** | (2006.01) |
| ***E05C 19/16*** | (2006.01) |
| ***E05C 17/60*** | (2006.01) |
| ***E05D 15/16*** | (2006.01) |
| ***E06B 5/00*** | (2006.01) |
| ***F26B 25/12*** | (2006.01) |

(52) U.S. Cl.

CPC ..... *E05C 19/16* (2013.01); *E05D 13/04* (2013.01); *E05D 15/165* (2013.01); *E06B 5/00* (2013.01); *F26B 25/12* (2013.01); *E05Y 2900/30* (2013.01)

(58) Field of Classification Search

CPC ..... E05C 19/16; E05C 19/163; E05C 19/161; E06B 7/20; F26B 25/12; E05Y 2900/30; E05B 65/0042

USPC ..... 49/366, 306, 313, 394; 126/197, 192, 126/194, 190

See application file for complete search history.

(56) References Cited

U.S. PATENT DOCUMENTS

| | | | | |
|---|---|---|---|---|
| 2,035,340 A * | 3/1936 | Primavera | ..... | B65D 7/065 206/37 |
| 2,524,924 A | 10/1950 | Pampallona | | |
| 2,607,961 A | 8/1952 | Allen | | |
| 3,133,324 A | 5/1964 | Foreman | | |

(Continued)

FOREIGN PATENT DOCUMENTS

| | | | |
|---|---|---|---|
| CN | 202788410 | U | 3/2013 |
| EP | 1949843 | A1 | 7/2008 |
| KR | 1020090097546 | A | 9/2008 |

OTHER PUBLICATIONS

Intellectual Property Office; UK Combined Search and Examination Report; Dated Aug. 22, 2017, pp. 1-7.

*Primary Examiner* — Chi Q Nguyen
(74) *Attorney, Agent, or Firm* — Taft Stettinius & Hollister LLP; Anthony P. Filomena, II

(57) ABSTRACT

A dehydrator is disclosed that includes a cavity, door and positioning mechanism. The cavity is defined by multiple walls and has an open front that the door covers. The door is movable between a closed position and a fully open position, and the positioning mechanism can stop and maintain the door at any partially open position in between. The positioning mechanism can be part of a door handle that can be used to move the door with one hand. The positioning mechanism can use magnets and the door tracks can be magnetic to hold the door at any desired position. The positioning mechanism can be movable between an engaged position where the magnets are connected to the door tracks, and a disengaged position where they are not connected. The dehydrator handle can include a hinge that moves the positioning mechanism between the engaged and disengaged positions.

21 Claims, 4 Drawing Sheets

(56) References Cited

U.S. PATENT DOCUMENTS 3,179,319 A * 4/1965 Barker ..... A41H 37/02 227/117
3,208,782 A 9/1965 Zeller
3,502,839 A 3/1970 Tibbs
3,505,945 A * 4/1970 Greer ..... B08B 15/023 312/263
4,079,558 A 3/1978 Gorham
4,079,772 A 3/1978 Klaenhammer et al.
4,152,842 A * 5/1979 Laughlin ..... F26B 9/003 219/400
4,221,059 A * 9/1980 Everitt ..... F26B 3/286 126/680
4,237,856 A * 12/1980 Trombatore ..... F24C 15/12 126/214 D
4,303,819 A 12/1981 Kaufman, Jr. et al.
4,575,966 A 3/1986 Gerritsen
5,016,527 A * 5/1991 Spamer ..... A47F 3/001 34/102
5,191,736 A * 3/1993 Iino ..... A47F 3/043 49/484.1
5,301,734 A 4/1994 Opel
5,332,021 A 7/1994 Todd et al.
5,425,205 A * 6/1995 Ha ..... E05B 65/0042 49/306
5,476,318 A * 12/1995 Yingst ..... E05B 1/0015 312/405
5,524,389 A 6/1996 Dennison
7,008,032 B2 * 3/2006 Chekal ..... F25D 11/02 312/405
7,337,824 B2 3/2008 Berger
7,857,402 B2 12/2010 Anikhindi et al.
8,292,383 B2 * 10/2012 Laible ..... E05B 65/0042 312/329
8,662,066 B2 * 3/2014 Franzolin ..... F24C 15/021 126/19 R
8,919,338 B2 12/2014 McNamee et al.
2009/0314028 A1 * 12/2009 Laible ..... E05C 19/161 62/449
2013/0247472 A1 * 9/2013 Mentasti ..... F25D 23/087 49/478.1

* cited by examiner

DEHYDRATOR DOOR OPENING DEVICE

FIELD OF THE DISCLOSURE

The present disclosure relates to dehydrators, and in particular to a dehydrator door opening and positioning device.

BACKGROUND

A traditional vertically sliding dehydrator door is normally completely closed or completely removed by sliding the dehydrator door up a door track and removing the dehydrator door in order to access the trays inside the dehydrator. When removed, the dehydrator door is usually placed on a level surface and the trays inside the dehydrator can be removed during unloading of the dehydrator or inserted during loading of the dehydrator. Sliding the dehydrator door up the door tracks and removing the dehydrator door to access the inside of the dehydrator is a two handed operation due to the size and weight of the dehydrator door and the desire to not damage the dehydrator door when removing it and placing it on a level surface. Reengaging the dehydrator door in the door tracks and lowering the dehydrator door to close the dehydrator is also a two handed operation due to the size and weight of the dehydrator door and the desire to properly engage the dehydrator door in the door tracks. The dehydrator door must be completely removed to access the trays inside the dehydrator. This creates a loss of heat in the dehydrator. Then closing the dehydrator requires reengaging the dehydrator door in the door tracks.

It would be desirable to have a vertically sliding dehydrator door that enables a user to partially open the dehydrator door and have the vertically sliding door be suspended in mid travel from any location along the up/down sliding door tracks. The ability to partially open the dehydrator door provides access to the trays inside the dehydrator, and reduces the amount of heat loss that may occur otherwise by having to completely remove the door of the dehydrator.

SUMMARY

A dehydrator is disclosed that includes a dehydrator cavity, a dehydrator door and a positioning mechanism. The dehydrator cavity is defined by a plurality of walls; and the dehydrator cavity has an open front side. The dehydrator door is configured to cover the open front side of the dehydrator cavity. The dehydrator door is movable between a closed position where the dehydrator door covers the open front side of the dehydrator cavity and a fully open position where the dehydrator door allows full access to the dehydrator cavity. The positioning mechanism can stop and maintain the dehydrator door at any of a plurality of selectable partially open positions between the closed position and the fully open position. The dehydrator can also include a dehydrator door handle, and the positioning mechanism can be part of the dehydrator door handle. The positioning mechanism can include a magnet and at least one of the plurality of walls defining the dehydrator cavity can be a magnetic wall, where the magnet of the positioning mechanism is connectable to the magnetic wall to stop and maintain the dehydrator door at any of the plurality of selectable partially open positions.

The plurality of walls defining the dehydrator cavity can include a top wall, a bottom wall, a right side wall and a left side wall; where the right side wall has a right side track and the left side wall has a left side track; and where the dehydrator door has a bottom side. The dehydrator door can slide vertically along the right and left side tracks between the closed position where the bottom side of the dehydrator door is substantially adjacent to the bottom wall and the fully open position where the bottom side of the dehydrator door is substantially adjacent to the top wall. The dehydrator door handle can extend substantially from the right side wall to the left side wall. The right and left side tracks can be magnetic, and the positioning mechanism can include a right side magnet and a left side magnet, where the right side magnet is connectable to the right side track and the left side magnet is connectable to the left side track to stop and maintain the dehydrator door any of the plurality of selectable partially open positions. The right side magnet can be attached to the right side of the dehydrator door handle, and the left side magnet can be attached to the left side of the dehydrator door handle. The positioning mechanism can be movable between an engaged position where the right side magnet is connected to the right side track and the left side magnet is connected to the left side track, and a disengaged position where the right side magnet is not connected to the right side track and the left side magnet is not connected to the left side track. The dehydrator handle can include a hinge that moves the positioning mechanism between the engaged position and the disengaged position. The dehydrator door can be raised and lowered between the closed and fully open positions and placed at any of the plurality of selectable partially open positions using one hand.

A dehydrator door is disclosed that is configured to cover the open front side of a dehydrator. The dehydrator door is movable between a closed position where the dehydrator door covers the open front side of the dehydrator and a fully open position where the dehydrator door allows full access to the open front side of the dehydrator. The dehydrator door includes a dehydrator door handle for raising and lowering the dehydrator door, and a positioning mechanism that can stop and maintain the dehydrator door at any of a plurality of selectable partially open positions between the closed position and the fully open position. The positioning mechanism can include a magnet and the dehydrator can include at least one magnetic surface, where the magnet of the positioning mechanism is connectable to the magnetic surface to stop and maintain the dehydrator door at any of the plurality of selectable partially open positions.

A dehydrator door handle is disclosed for raising and lowering a dehydrator door configured to cover the open front side of a dehydrator. The dehydrator door handle includes a positioning mechanism that can stop and maintain the dehydrator door at any of a plurality of selectable partially open positions between the closed position and the fully open position. The positioning mechanism can include a magnet and the dehydrator can include at least one magnetic surface, where the magnet of the positioning mechanism is connectable to the magnetic surface to stop and maintain the dehydrator door at any of the plurality of selectable partially open positions. The positioning mechanism can include right and left side magnets attached to the right and left sides of the dehydrator door handle. The positioning mechanism can be movable between an engaged position where the right and left side magnets are connected to right and left side magnetic tracks, and a disengaged position where the right and left side magnets are not connected to the right and left side magnetic tracks.

BRIEF DESCRIPTION OF THE DRAWINGS

The above-mentioned aspects of the present disclosure and the manner of obtaining them will become more apparent and the disclosure itself will be better understood by reference to the following description of the embodiments of the disclosure, taken in conjunction with the accompanying drawings, wherein.

Corresponding reference numerals are used to indicate corresponding parts throughout the several views.

DETAILED DESCRIPTION

The embodiments of the present disclosure described below are not intended to be exhaustive or to limit the disclosure to the precise forms in the following detailed description. Rather, the embodiments are chosen and described so that others skilled in the art may appreciate and understand the principles and practices of the present disclosure.

Figure 1:
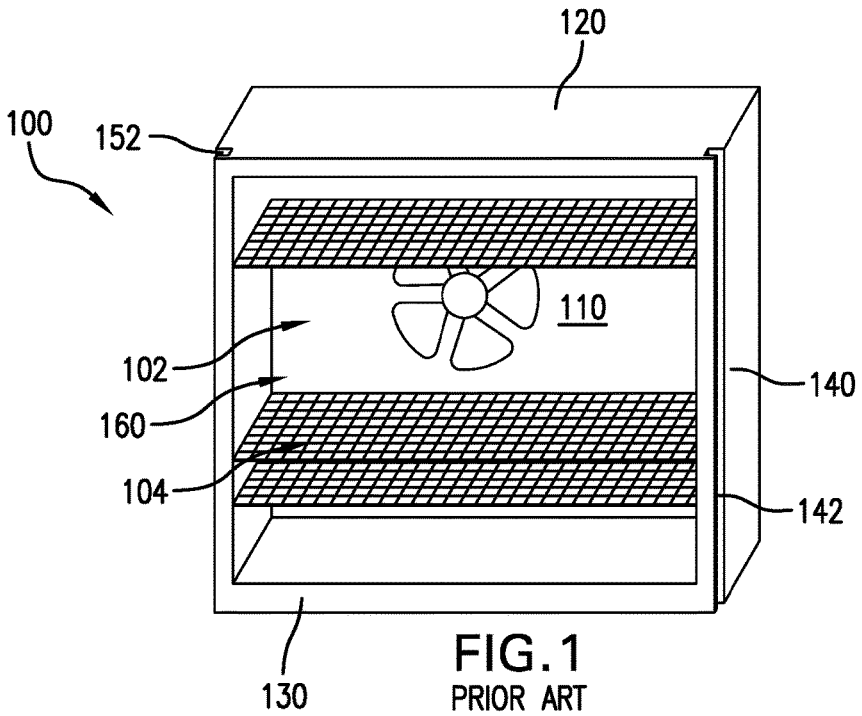
FIG. 1 PRIOR ART
FIG. 1 illustrates an exemplary dehydrator that is open, cover removed.

FIG. 1 illustrates an exemplary prior art dehydrator 100 that is open (cover removed). The dehydrator 100 includes an inner cavity 102 defined by a back wall 110, a top wall 120, a bottom wall 130, a right side wall 140 and a left side wall 150. A front opening 160 provides access to the inner cavity 102. The front of the right side wall 140 includes a right door track 142 and the front of the left side wall 150 includes a left door track 152. The fronts of the right and left side walls 140, 150 are adjacent to the front opening 160. One or more trays 104 can be positioned in the inner cavity 102, and accessed through the front opening 160. The trays 104 can be slidably coupled to the right and left side walls 140, 150 in the inner cavity 102.

Figure 2:
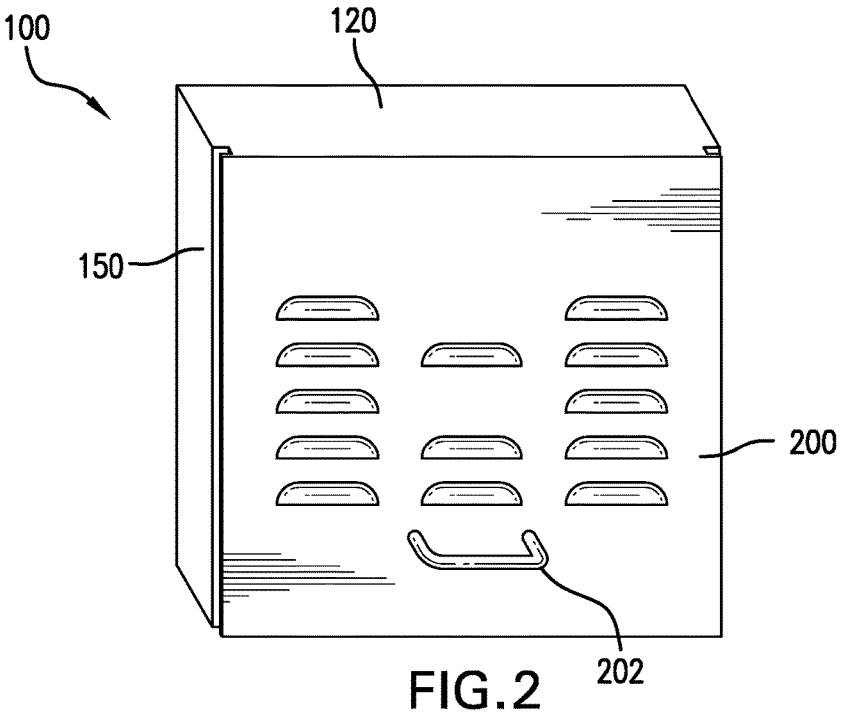
FIG. 2 PRIOR ART
FIG. 2 illustrates the exemplary dehydrator of FIG. 1 with a dehydrator door or cover attached to cover the front opening and close the inner cavity of the dehydrator.

FIG. 2 illustrates the exemplary dehydrator 100 with a dehydrator door or cover 200 attached to cover the front opening 160 and close the inner cavity 102. A handle 202 is attached to the front of the dehydrator door 200 to raise and lower the dehydrator door 200. The dehydrator door 200 is slidably coupled to the right and left side walls 140, 150, and slides vertically in the right and left door tracks 142, 152.

The dehydrator door 200 of the prior art dehydrator 100 of FIGS. 1 and 2 is either removed (FIG. 1) or attached and closed (FIG. 2). There is no mechanism to position the dehydrator door in a partially open position. Removing or reattaching the dehydrator door 200 from the door tracks 142, 152 is a two handed operation.

FIGS. 3-6 show an exemplary dehydrator 300 with a dehydrator door 310 that includes a dehydrator door handle 312. The dehydrator 300 includes an inner cavity 302 defined by a back wall 320, a top wall 330, a bottom wall 340, a right side wall 350 and a left side wall 360. A front opening 370 provides access to the inner cavity 302. The front of the right side wall 350 includes a right door track 352 and the front of the left side wall 360 includes a left door track 362. The front sides of the right and left side walls 350, 360 are adjacent to the front opening 370. One or more trays 304 can be positioned in the inner cavity 302, and accessed through the front opening 370. The trays 304 can be slidably coupled to the right and left side walls 350, 360 in the inner cavity 302. The dehydrator door 310 slides up and down along the right and left door tracks 352, 362.

The dehydrator door handle 312 is a generally horizontal handle and extends substantially across the width of the dehydrator door 310. The dehydrator door handle 312 slides up and down the right and left door tracks 352, 362 with the dehydrator door 310. The dehydrator door handle 312 can be used to stop and lock the dehydrator door 310 at any location along the right and left door tracks 352, 362.

The door tracks 352, 362 can be made of a magnetic material and the dehydrator door handle 312 can have a right side magnet 354 and a left side magnet 364 connected near opposite ends of the dehydrator door handle 312. In this embodiment, the dehydrator door 310 can be can be slid along the door tracks 352, 362 and stopped when the door 310 is at the desired location by bringing the right and left side magnets 354, 364 into contact with the magnetic right and left side door tracks 352, 362, respectively. The magnets 354, 364 can be selected to have the necessary strength to hold the dehydrator door 310 at the selected location.

This dehydrator door handle 312 allows the dehydrator door 310 to be partially opened, and stopped at any point along the door tracks 352, 362 in order to load, remove, rotate or view trays in the dehydrator 300. Being able to access trays 304 inside the dehydrator 300 without needing to completely remove the dehydrator door 300, minimizes heat loss in the inner cavity 302 of the dehydrator 300.

Figure 3:
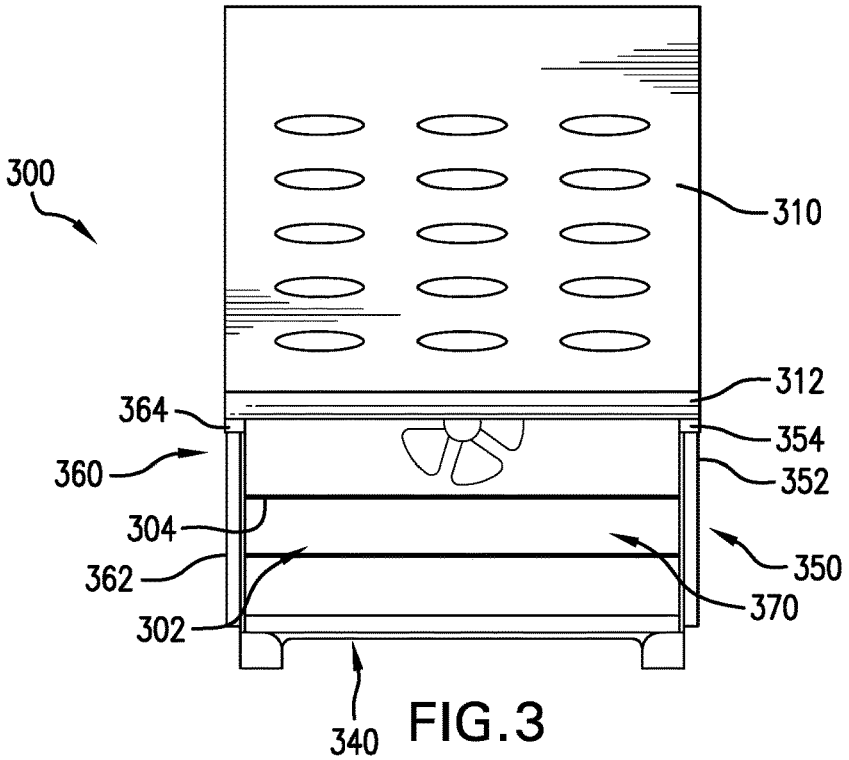
FIG. 3 illustrates a front view of an exemplary dehydrator with the dehydrator door partially open and stopped at a selected location.
Figure 4:
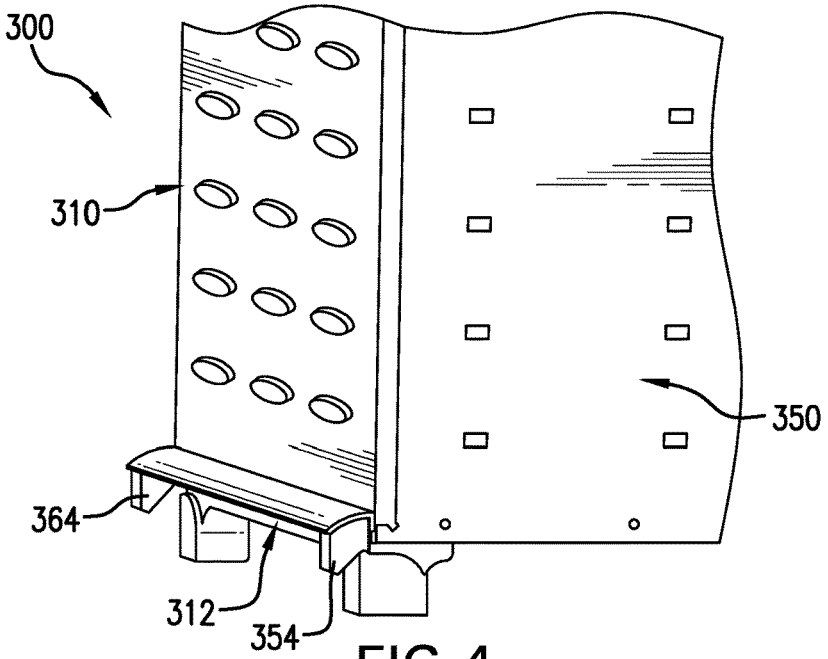
FIG. 4 illustrates a side view of the dehydrator of FIG. 3 with the dehydrator door closed.
Figure 5:
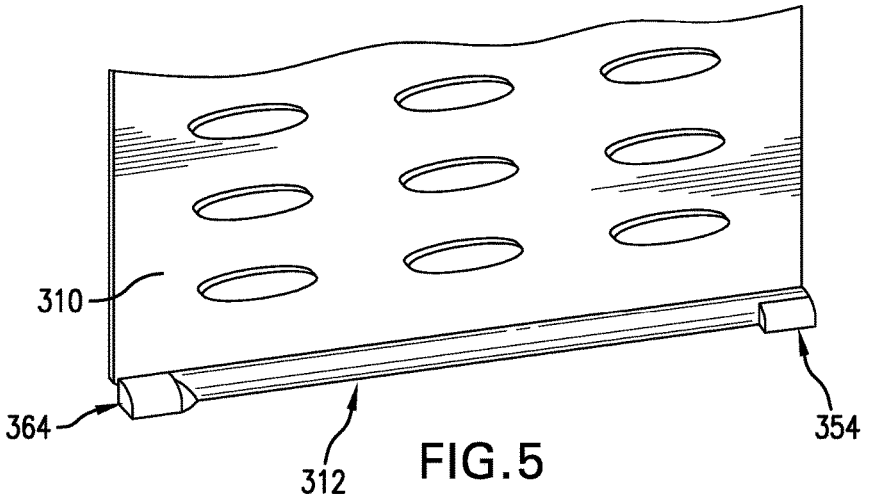
FIG. 5 illustrates a front view of the dehydrator of FIG. 3 with the dehydrator door closed.
Figure 6:
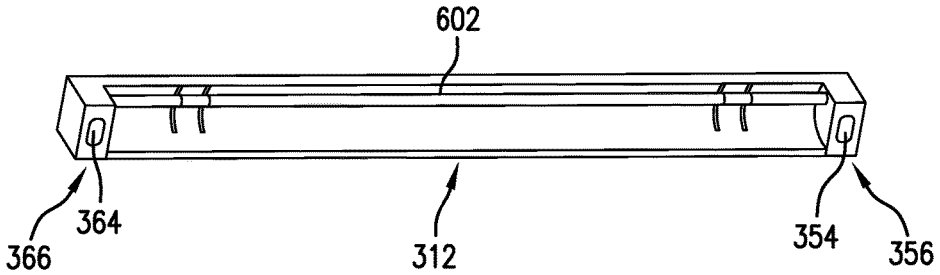
FIG. 6 illustrates an exemplary dehydrator door handle with magnets mounted at each end.

FIG. 3 shows a front view of the exemplary dehydrator 300 with the dehydrator door 310 partially open and stopped at a selected location. FIG. 4 shows a side view of the exemplary dehydrator 300 with the dehydrator door 310 closed, and FIG. 5 shows a front view of the exemplary dehydrator 300 with the dehydrator door 310 closed. FIG. 6 shows an exemplary dehydrator door handle 312 with the magnets 354, 364 mounted at each end. FIG. 6 also shows a handle rod 602 that can be used to couple the dehydrator handle 312 to the door 310.

The dehydrator door handle 312 can be a molded aluminum bar with plastic mounts 356, 366 at the right and left ends, respectively. The right side magnet 354 can be attached to the right side plastic mount 356, and the left side magnet 364 can be attached to the left side plastic mount 366. The magnets 354, 364 can be mounted at the ends of the handle 312 to allow the magnets 354, 364 to easily reach the door tracks 352, 362 when engaged, and to keep the magnets 354, 364 away from door tracks 352, 362 and other metal when not required. The magnets 354, 364 can also be mounted to provide a space for a user's fingers during opening and closing of the dehydrator door 310 to help prevent fingers from touching trays or other hot surfaces during opening/closing operations.

Alternatively, the dehydrator door handle 312 can be a shaft/rod or other generally horizontal structure. Alternative methods can be used to position and stop the dehydrator door in a partially open position. For example, a spring can be attached at each end of the door handle, and the spring can be pushed up/down to engage with the door tracks to hold the dehydrator door in position in the track.

Figure 7:
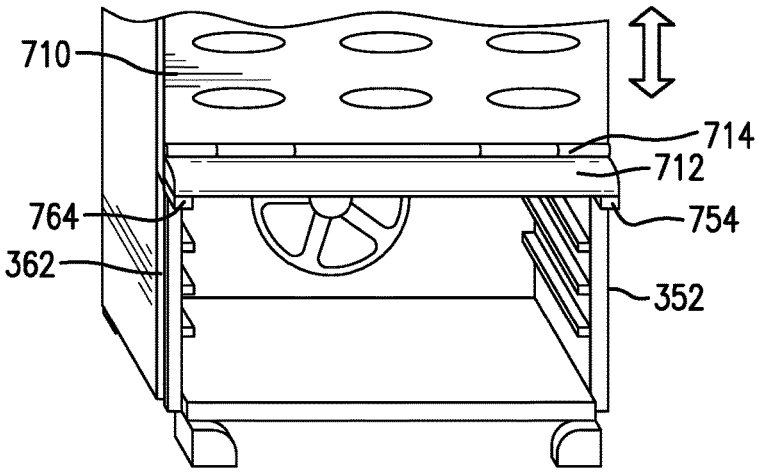
FIG. 7 illustrates an exemplary embodiment of a dehydrator door handle with magnets where the handle is mounted to a dehydrator door using a hinge, and the hinge is closed bringing the magnets into contact with the door tracks.
Figure 8:
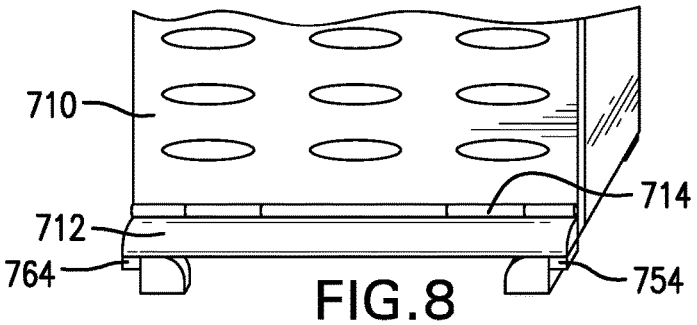
FIG. 8 illustrates the exemplary embodiment of the dehydrator door handle with magnets where the handle is mounted to the dehydrator door using the hinge, and the hinge is open moving the magnets away from the door tracks.

FIGS. 7 and 8 illustrate an exemplary embodiment of a dehydrator door handle 712 with magnets 754, 764, where the handle 712 is coupled to a dehydrator door 710 by a hinge 714 to avoid the resistance forces created by the magnets when sliding the dehydrator door along the door tracks. When the dehydrator door handle 712 is tilted in or against the door tracks 352, 362 as shown in FIG. 7, the magnets 754, 764 are coupled to the door tracks 352, 362 so that the magnets 754, 764 hold the dehydrator door 710 in a desired or selected position. When the dehydrator door handle 712 is tilted out or away from the door tracks 352, 362 as shown in FIG. 8, the magnets 754, 764 are raised up or away from the door tracks 352, 362 so the magnets 754, 764 do not resist the raising and lowering of the dehydrator door 710. This allows the door 710 to be moved up and down the door tracks 352, 362 without having to overcome the full pull of the magnets 754, 764. The handle rod 602 shown in FIG. 6 can be used in the dehydrator door handle 712 to form part of the hinge 714.

While the disclosure has been illustrated and described in detail in the drawings and foregoing description, such illustration and description is to be considered as exemplary and not restrictive in character, it being understood that illustrative embodiment(s) have been shown and described and that all changes and modifications that come within the spirit of the disclosure are desired to be protected. It will be noted that alternative embodiments of the present disclosure may not include all of the features described yet still benefit from at least some of the advantages of such features. Those of ordinary skill in the art may readily devise their own implementations that incorporate one or more of the features of the present disclosure and fall within the spirit and scope of the present invention as defined by the appended claims.

I claim:

1. A dehydrator comprising:

a dehydrator cavity defined by a plurality of walls, wherein at least one of the plurality of walls is a magnetic wall and the dehydrator cavity has an open front side;

a dehydrator door configured to cover the open front side of the dehydrator cavity and configured to move vertically between a closed position where the dehydrator door covers the open front side of the dehydrator cavity and a fully open position where the dehydrator door allows full access to the dehydrator cavity; and a dehydrator door handle comprising a magnet, and configured to vertically stop and maintain the dehydrator door at a selectable partially open position between the closed position and the fully open position;

wherein the magnet of the dehydrator door handle is connectable to the magnetic wall to vertically stop and maintain the dehydrator door at the selectable partially open position.

2. The dehydrator of claim 1, wherein the plurality of walls defining the dehydrator cavity comprises a top wall, a bottom wall, a right side wall and a left side wall; the right side wall having a right side track and the left side wall having a left side track; and wherein the dehydrator door has a bottom side;

wherein the dehydrator door slides vertically along the right and left side tracks between the closed position where the bottom side of the dehydrator door is substantially adjacent to the bottom wall and the fully open position where the bottom side of the dehydrator door is substantially adjacent to the top wall.

3. The dehydrator of claim 2, wherein the dehydrator door handle extends substantially from the right side wall to the left side wall.

4. The dehydrator of claim 3, wherein the right side track is magnetic and the left side track is magnetic, and the magnet of the dehydrator door handle comprises a right side magnet attached to the right side of the dehydrator door handle, and a left side magnet attached to the left side of the dehydrator door handle;

wherein the right side magnet of the dehydrator door handle is configured to connect to the right side track and the left side magnet of the dehydrator door handle is configured to connect to the left side track to vertically stop and maintain the dehydrator door at the selectable partially open position.

5. The dehydrator of claim 4, wherein the dehydrator door handle is configured to move between an engaged position where the right side magnet is connected to the right side track and the left side magnet is connected to the left side track, and a disengaged position where the right side magnet is not connected to the right side track and the left side magnet is not connected to the left side track.

6. The dehydrator of claim 5, wherein the dehydrator door handle includes a hinge configured to move the dehydrator door handle between the engaged position and the disengaged position.

7. The dehydrator of claim 6, wherein the dehydrator door can be raised and lowered between the closed and fully open positions and placed at the selectable partially open position using one hand.

8. The dehydrator of claim 2, wherein at least one of the right side track of the right side wall and the left side track of the left side wall is a magnetic track, the magnetic track being magnetic, and the dehydrator door handle extends to the magnetic track, and wherein the magnet of the dehydrator door handle is configured to connect to the magnetic track to vertically stop and maintain the dehydrator door at the selectable partially open position.

9. The dehydrator of claim 8, wherein the dehydrator door handle is configured to move between an engaged position where the magnet of the dehydrator door handle is connected to the magnetic track, and a disengaged position where the magnet of the dehydrator door is not connected to the magnetic track.

10. The dehydrator of claim 9, wherein the dehydrator door handle includes a hinge configured to move the dehydrator door handle between the engaged position and the disengaged position.

11. A dehydrator door configured to cover an open front side of a dehydrator, the dehydrator door being movable between a closed position where the dehydrator door covers the open front side of the dehydrator and a fully open position where the dehydrator door allows full access to the open front side of the dehydrator; the dehydrator door comprising:

a dehydrator door handle configured to vertically raise and lower the dehydrator door between the fully open position and the closed position; and wherein the dehydrator door handle is configured to vertically stop and maintain the dehydrator door at any of a plurality of selectable partially open positions between the closed position and the fully open position; and wherein the dehydrator door slides vertically along one or more tracks between the closed position and the fully open position.

12. The dehydrator door of claim 11, wherein the dehydrator door handle comprises a magnet and the dehydrator includes at least one magnetic surface, and wherein the magnet of the dehydrator door handle is configured to connect to the magnetic surface to stop and maintain the dehydrator door at any of the plurality of selectable partially open positions.

13. The dehydrator door of claim 12, wherein the dehydrator door handle includes a hinge configured to move the dehydrator door handle between an engaged position where the magnet of the dehydrator door handle is connected to the magnetic surface, and a disengaged position where the magnet of the dehydrator door handle is not connected to the magnetic surface.

14. The dehydrator door of claim 11, wherein the dehydrator door has a door width, and the dehydrator door handle extends substantially the entire door width of the dehydrator door.

15. The dehydrator door of claim 14, wherein the dehydrator includes a right side magnetic track and a left side magnetic track, and the dehydrator door handle comprises a right side magnet attached to the right side of the dehydrator door handle, and a left side magnet attached to the left side of the dehydrator door handle;

wherein the right side magnet of the dehydrator door handle is configured to connect to the right side magnetic track and the left side magnet of the dehydrator door handle is configured to connect to the left side magnetic track to stop and maintain the dehydrator door at any of the plurality of selectable partially open positions.

16. The dehydrator door of claim 15, wherein the dehydrator door handle is movable between an engaged position where the right side magnet is connected to the right side magnetic track and the left side magnet is connected to the left side magnetic track, and a disengaged position where the right side magnet is not connected to the right side magnetic track and the left side magnet is not connected to the left side magnetic track.

17. The dehydrator door of claim 16, wherein the dehydrator door can be raised and lowered between the closed and fully open positions and placed at any of the plurality of selectable partially open positions using one hand.

18. A dehydrator door handle for raising and lowering a dehydrator door configured to cover an open front side of a dehydrator, the dehydrator door being movable between a closed position where the dehydrator door covers the open front side of the dehydrator and a fully open position where the dehydrator door allows full access to the open front side of the dehydrator; the dehydrator door handle comprising:

a door stop configured to vertically stop and maintain the dehydrator door at any of a plurality of selectable partially open positions between the closed position and the fully open position;

wherein the dehydrator door has a door width, and the dehydrator door handle extends substantially the entire door width of the dehydrator door.

19. The dehydrator door handle of claim 18, wherein the door stop comprises a magnet and the dehydrator includes at least one magnetic surface, and wherein the magnet of the door stop is configured to connect to the magnetic surface to vertically stop and maintain the dehydrator door at any of the plurality of selectable partially open positions.

20. The dehydrator door handle of claim 18, wherein the door stop comprises a right side magnet attached to the right side of the dehydrator door handle, and a left side magnet attached to the left side of the dehydrator door handle.

21. The dehydrator door handle of claim 20, wherein the door stop is movable between an engaged position where the right side magnet is connected to a right side magnetic track and the left side magnet is connected to a left side magnetic track, and a disengaged position where the right side magnet is not connected to the right side magnetic track and the left side magnet is not connected to the left side magnetic track.

* * * * *